US005933095A

United States Patent [19]

Junker

[11] Patent Number: 5,933,095

[45] Date of Patent: Aug. 3, 1999

[54] TRAFFIC BEACON, WHICH CAN BE USED AS A GUIDING DEVICE, ESPECIALLY FOR STREET TRAFFIC

[76] Inventor: Wilhelm Junker, Reutlinger Str. 14, 71522 Backnang, Germany

[21] Appl. No.: 08/984,664

[22] Filed: Dec. 3, 1997

[30] Foreign Application Priority Data

Nov. 7, 1997 [DE] Germany ..... 297 19 833 U

[51] Int. Cl.[6] ..... G08G 1/095

[52] U.S. Cl. ..... 340/908; 340/908.1; 404/9; 116/63 R; 116/63 P

[58] Field of Search ..... 340/908, 908.1; 116/63 P, 202, 63 R, 173, 174, 175, 63 C; 404/10, 6, 9; 248/910; 40/608, 612

[56] References Cited

U.S. PATENT DOCUMENTS

| | | | |
|---|---|---|---|
| 3,851,616 | 12/1974 | Brown | 116/63 R |
| 4,137,662 | 2/1979 | Baumer | 40/612 |
| 4,864,299 | 9/1989 | Kuhl | 340/908.1 |
| 5,165,818 | 11/1992 | Newhart | 404/10 |
| 5,273,371 | 12/1993 | Hugron | 404/10 |
| 5,452,965 | 9/1995 | Hughes, Sr. | 404/10 |
| 5,520,141 | 5/1996 | Lutz | 116/173 |
| 5,670,954 | 9/1997 | Junker | 340/908.1 |
| 5,703,577 | 12/1997 | Carter | 340/908 |

FOREIGN PATENT DOCUMENTS

WO96/26321 8/1996 WIPO .

*Primary Examiner*—Nina Tong
*Attorney, Agent, or Firm*—Jordan and Hamburg LLP

[57] ABSTRACT

A traffic beacon, which can be used as a guiding device, particularly for street traffic, has a top member which is provided with warning or informative signs. The top member flips over when a vehicle drives over it. The lower end of the top member is connected via a tilting joint to a foot plate or directly to the street surface. Each tilting joint is provided with a spring-loaded locking device, a first stop holding the top member in the vertical position and a second stop serving as a locking device for the top member in a prone position.

21 Claims, 2 Drawing Sheets

TRAFFIC BEACON, WHICH CAN BE USED AS A GUIDING DEVICE, ESPECIALLY FOR STREET TRAFFIC

BACKGROUND OF THE INVENTION

The invention relates to a traffic beacon, which can be used as a guiding device, especially for street traffic, with a top member which is provided with warning or informative signs and which flips over when a vehicle drives over it. The traffic beacon can be used to separate traffic lanes and also for areas serving stationary traffic, such as parking lots.

A traffic beacon of the aforementioned type is known, for example, from the PCT application WO 96/26321. The top member is connected with a foot plate or with a continuous guiding beam and has a nominal bending site in its lower part. This nominal bending site consists of a soft, elastic material. Its function is to enable the traffic beacon to be driven over and, after that, to resume an upright position automatically. Since the top member offers a certain resistance when bent, particularly when the collision angle is unfavorable, the traffic beacon, in the most unfavorable case when only a single traffic beacon is set up, can be flung away in the event of a collision. This is, of course, not desirable.

At short-term construction sites, guiding cones in the form of pointed hats are generally set up. These guiding cones have the disadvantage that they are flung away or jammed under a vehicle in the event of a collision or that they are flung into the windshield of a vehicle coming in the opposite direction. Accordingly, control over the vehicle is no longer assured. Furthermore, the driver, who follows, does not realize that previously there was a guiding cone at this place. Moreover, due to the rounding, the thin sheet surface is not visible as readily as it would be in the case of a flat surface.

SUMMARY OF THE INVENTION

It is an object of the invention to construct a traffic beacon, which is to function as a guiding device, in such a manner, that it cannot be flung away in the case of a collision.

In accordance with these and other objects of the invention, there is provided a traffic beacon with a top member, provided with warning or informative signs, which flips over when a vehicle drives over it. The traffic beacon has a lower end of the top member connected by a pair of tilting joints to a foot plate, or directly to a street surface, and each tilting joint is provided with a spring-loaded locking device having a first stop for holding the top member in a vertical position and a second stop for locking the top member in a prone position when the top in knocked down by a vehicle.

In the use position, the traffic beacon has the top member maintained in the upright position by the locking device. When there is collision with a vehicle, the first stop is overcome and the top member is flipped over. In the flipped-over state, the second stop becomes effective and holds the top in the prone position. A relatively slight force is required to unlock the lock effective in the upright position of the top member. The top member is set up once again primarily by hand.

According to a feature of the invention, each tilting joint consists of two identical parts, of which one is connected to the top member and the other is connect to the foot plate, or the street surface, and each of the parts has an axle channel through which a horizontal axle passes.

The present invention further includes a traffic beacon wherein each of the parts of the tilting joints is provided with a noncircular recess for accommodating an element of the locking device.

According to a still further feature of the invention, one of the elements of the locking device carries locking grooves, disposed in cross-shaped fashion in an outwardly directed surface, the other element of the locking device carries a locking rib, and at least one of the elements of the locking device is biased by a disk spring which presses the elements of the locking device against one another. In an embodiment the disk spring is accommodated at a bottom of the noncircular recess.

Yet further features of the present invention include the top member being constructed as a rectangular or trapezoidal plate and the plate being provided with flanges protruding on both sides of a plate surface of the plate.

According to a still further feature of the invention, the top member has downwardly protruding pegs fixed in appropriately shaped recesses in one of the parts of the tilting joint.

Yet another feature of the present invention includes the horizontal axle being firmly connected the part of the tilting joint connected to the top member and being constructed as an outwardly protruding shaft for engagement by a driving mechanism such as a motor.

Because two identical parts are used for each tilting joint, the number of elements, which must be kept in stock, is reduced.

The elements of the locking device are subject to wear and therefore are accommodated exchangeably in recesses of parts of the tilting joint.

Instead of setting the top member up again by hand, it is also possible to use an electric motor for this purpose, which then acts on a tilting axis that is constructed as a shaft.

BRIEF DESCRIPTION OF THE DRAWINGS

In the following, the invention is explained in greater detail by means of an example, which is shown in the drawings, wherein.

DETAILED DESCRIPTION OF THE INVENTION

Figure 1A:
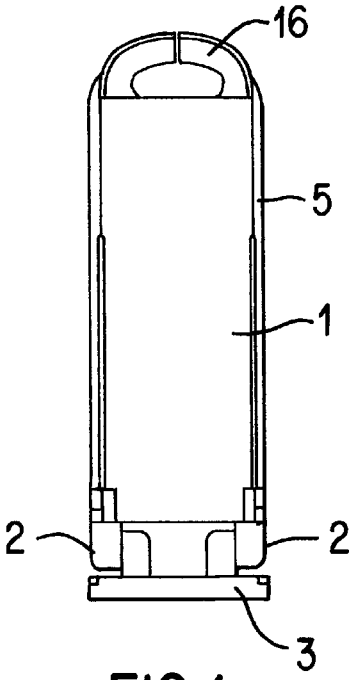
FIG. 1*a* shows a front view of a traffic beacon, provided with a foot plate.
Figure 1B:
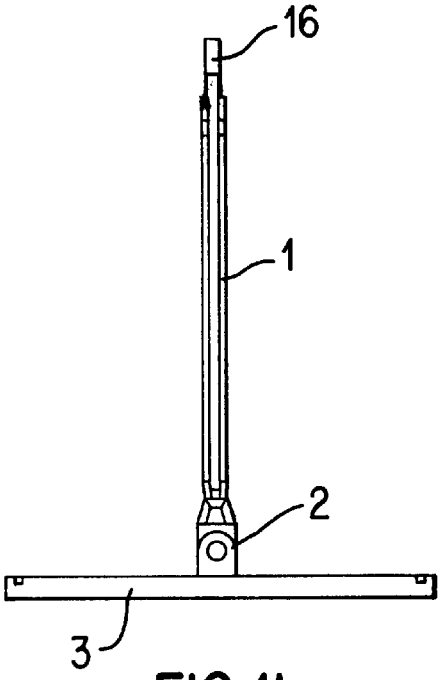
FIG. 1*b* shows a side view of the traffic beacon of FIG. 1*a;*

The traffic beacon, shown in FIGS. 1*a* and 1*b*, consists of a top member 1, which is connected at its underside by two tilting joints 2 to a foot plate 3. The plate-shaped top member 1 has at its upper side a handle 16 and is provided at the sides with flanges 5, which protrude on both sides from a plate surface of the top member 1. The plate surface is provided in a known manner with warning or informative signs, which can easily be perceived optically and, in particular, are reflective.

Figure 2:
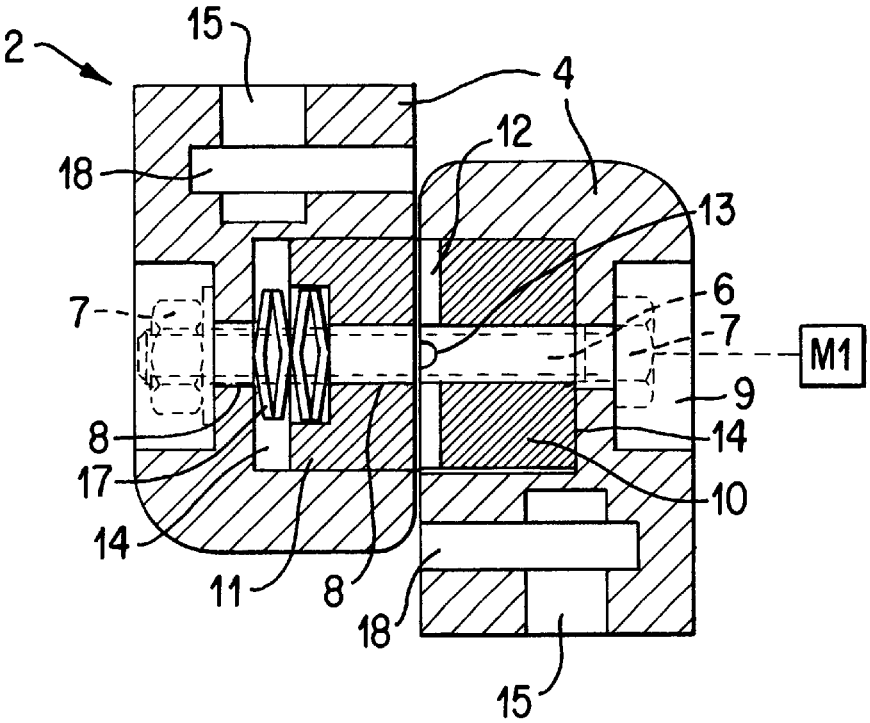
FIG. 2 shows a vertical cross section of a tilting joint of the traffic beacon.

The tilting joint 2, which is disposed at the left in FIG. 1*a*, is shown in FIG. 2. The tilting joint 2 includes two identically constructed parts 4, of which the left part 4 is firmly connected with the underside of the top member 1 and the right part 4 is connected to the foot plate 3. For the respective fastening, there are recesses 15, into which fastening parts are inserted and secured in position by bolts passed through channels 18 extending at right angles to the recesses 15. The parts 4 are held together by an axle 6, which is passed through an axle channel 8. The axle 6 is constructed as a screw bolt with nuts 7, belonging to the screw bolt, being accommodated in indentations 9 in the left and right parts 4. At the side opposite the indentation 9, each part 4 has a non-circular recess 14, shown in FIG. 3, in which first and second locking elements 10 and 11 of a locking device are accommodated.

The first locking element 10, accommodated in the right part 4 that is connected with the foot plate 3, has locking grooves 12 which are disposed cross-shaped in its surface, whereas the second locking element 11 provided with a locking rib 13 and is disposed in the left part 4. Between the back side of the second locking element 11 and a bottom of the recess 14, a disk spring 17 is disposed, by means of which pretension between the first and second locking elements 10 and 11 of the locking device is produced.

In FIG. 2, the tilting joint 2 is shown with the top member 1 in the upright position. In this case, the horizontally disposed locking rib 13, under the action of the disk spring 17, engages the horizontal locking groove 12 and, with that, operates as a detent device and rotationally locks the left and right parts 4 together.

If a vehicle collides with the top 1, the locking is overcome by compression of the disk spring 17 and the top 1 is brought into a position which runs approximately perpendicularly to the upright position. In this position, the locking rib 13 locks in the vertical locking groove 12.

The top member 1 is placed in the upright position once again manually or by means of an optionally provided motor M1 wherein the axle 6 is firmly connected to the left part 11 connected to the top 1 and is constructed as an outwardly protruding shaft driven by the motor M1.

Figure 3:
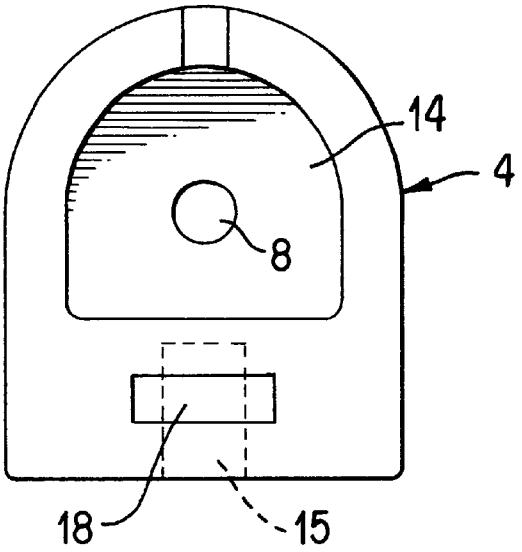
FIG. 3 shows a part of the tilting joint in front view.
Figure 4A:
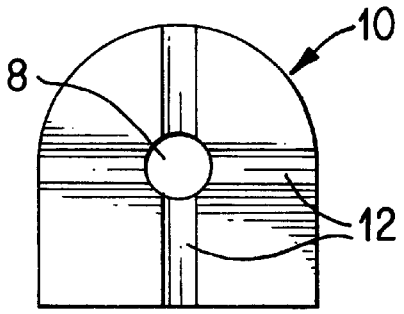
FIG. 4*a* shows a front view of a locking element provided with locking grooves.
Figure 4B:
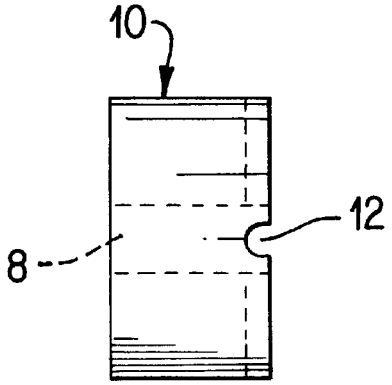
FIG. 4*b* shows a side view of the locking element of FIG. 4*a;*
Figure 5A:
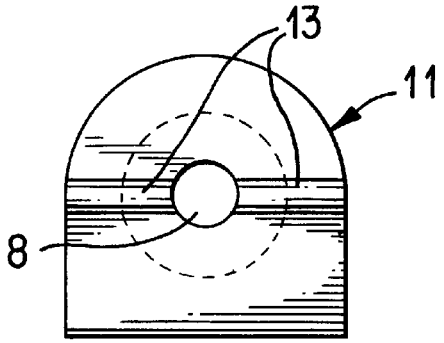
FIG. 5*a* shows a front view of a locking element provided with a locking rib.
Figure 5B:
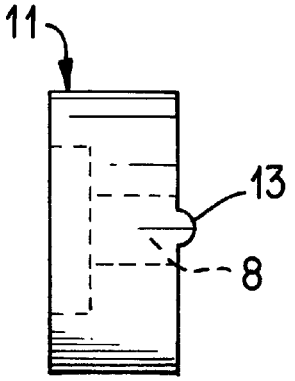
FIG. 5*b* shows a side view of the locking element of FIG. 4*a.*

FIG. 3 shows that the recess 15 has the shape of a rectangle on which a semicircle is placed. However, any other configuration, by means of which mutual rotation between the left and right parts 4 and the locking elements 10 and 11 inserted therein is avoided, is conceivable.

FIGS. 1*a* and 1*b* show that the top member 1 is fastened over the tilting joint 20 2 to the foot plate 3. However, the tilting joints 2 can also be fastened directly to a roadway surface and, moreover, in such a manner that stone bolts, set in concrete, engage the recesses 15.

Aside from using the traffic beacon, constructed pursuant to the present invention, as a guiding device for vehicles, the traffic beacon may be used for stationary traffic to keep parking places free. A parking place can be kept free for the owner by setting up the traffic beacon in front of it with a top member which is provided with a parking or no stopping sign. When the parking space is in use, the top member is bent over by a bumper of the vehicle and brought into a prone position. Upon leaving the parking space, the top member must be erected once again by the owner of the parking space.

The traffic beacon, constructed pursuant to the invention, can even be used in a horizontal position, in that the tilting joints are fastened to a wall. By these means, access to a space can be blocked.

I claim:

1. A traffic beacon comprising:

a top member having a lower end;

a foot plate;

a tilting joint mechanism connecting the lower end of the top member to the foot plate such that the top member is pivotable with respect to the foot plate between a vertical position and a prone position; and the tilting joint mechanism having a spring-loaded locking device with a first stop position for detentially holding the top member in the vertical position and a second stop position for detentially holding the top member in the prone position.

2. The traffic beacon of claim 1, wherein the top member is a plate having one of a rectangular and trapezoidal shape.

3. The traffic beacon of claim 2, wherein the plate has sides with flanges.

4. The traffic beacon of claim 1, wherein the top member has a downwardly protruding peg and the tilting joint mechanism has a shaped recess engaging the downwardly protruding peg.

5. The traffic beacon claim 1, further comprising the top member having an upper side with a handle.

6. The traffic beacon of claim 1, further comprising:

the tilting joint mechanism including:

first and second parts, the first part being connected to the top member and the second part being connected to the foot plate;

each of the first and second parts having an axle channel; and a horizontal axle extending through the axle channels of the first and second parts to secure the first and second parts together such that the first part and the second part are pivotable with respect to each other about an axis of the horizontal axle to permit the top member to pivot between the vertical position and the prone position;

the horizontal axle being fixed to the first part of the tilting joint mechanism; and a motor driving the horizontal axle to move the top member between the vertical position and the prone position.

7. A traffic beacon comprising:

a top member having a lower end;

a foot plate;

a tilting joint mechanism connecting the lower end of the top member to the foot plate such that the top member is pivotable with respect to the foot plate between a vertical position and a prone position;

the tilting joint mechanism having a spring-loaded locking device with a first stop position for holding the top member in the vertical position and a second stop position for holding the top member in the prone position; and the tilting joint mechanism including:

first and second parts the first part being connected to the top member and the second part being connected to the foot plate;

each of the first and second parts having an axle channel;

a horizontal axle extending through the axle channels of the first and second parts to secure the first and second parts together such that the first part and the second part are pivotable with respect to each other about an axis of the horizontal axle to permit the top member to pivot between the vertical position and the prone position.

8. The traffic beacon of claim 7, wherein each of the first and second parts has a noncircular recess accommodating respectively a first locking element and a second locking element, the first locking element and the second locking element each have an engagement face engaging the engagement face of the other, and the engagement faces having stop means for rotationally holding the top member at the vertical position and the prone position.

9. The traffic beacon of claim 8, wherein the stop means includes:

the engagement face of one of the first and second locking elements having locking grooves disposed in cross-shaped fashion;

the engagement face of another one of the first and second locking elements having a locking rib for engaging the locking grooves; and at least one of the first and second locking elements having a spring biasing the engagement face of the at least one of the first and second locking elements towards the engagement face of another of the first and second locking elements.

10. The traffic beacon of claim 9, wherein the spring is a disk spring accommodated at a bottom of the noncircular recess of the at least one of the first and second locking elements.

11. The traffic beacon of any one of claims 7 to 10, wherein the top member is a plate having one of a rectangular and trapezoidal shape.

12. The traffic beacon of claim 11, wherein the plate has sides with flanges.

13. The traffic beacon of any one of claims 7 to 10, wherein the top member has a downwardly protruding peg and the first part of the tilting joint mechanism has a shaped recess engaging the downwardly protruding peg.

14. The traffic beacon of any one of claims 7 to 10, further comprising the top member having an upper side with a handle.

15. The traffic beacon of claims 7, 8, 9 or 10, further comprising:

the horizontal axle being fixed to the first part of the tilting joint mechanism; and a motor driving the horizontal axle to move the top member between the vertical position and the prone position.

16. A traffic beacon for attachment to a street surface, comprising:

a top member having a lower end;

a tilting joint mechanism for connecting the lower end of the top member to the street surface such that the top member is pivotable, with respect to the street surface, between a vertical position and a prone position; and the tilting joint mechanism having a spring-loaded locking device with a first stop position for detentially holding the top member in the vertical position and a second stop position for detentially holding the top member in the prone position.

17. The traffic beacon of claim 16, wherein the tilting joint mechanism includes:

first and second parts, the first part being connected to the top member and the second part being connectable to the street surface;

each of the first and second parts having an axle channel; and a horizontal axle extending through the axle channels of the first and second parts to secure the first and second parts together such that the first part and the second part are pivotable with respect to each other about an axis of the horizontal axle to permit the top member to pivot between the vertical position and the prone position.

18. The traffic beacon of claim 17, wherein each of the first and second parts has a noncircular recess accommodating respectively a first locking element and a second locking element, the first locking element and the second locking element each have an engagement face engaging the engagement face of the other, and the engagement faces having stop means for rotationally holding the top member at the vertical position and the prone position.

19. The traffic beacon of claim 18, wherein the stop means includes:

the engagement face of one of the first and second locking elements having locking grooves disposed in cross-shaped fashion;

the engagement face of another one of the first and second locking elements having a locking rib for engaging the locking grooves; and at least one of the first and second locking elements having a spring biasing the engagement face of the at least one of the first and second locking elements towards the engagement face of another of the first and second locking elements.

20. The traffic beacon of claim 19, wherein the spring is a disk spring accommodated at a bottom of the noncircular recess of the at least one of the first and second locking elements.

21. The traffic beacon of any one of claims 17–20, further comprising:

the horizontal axle being fixed to the first part of the tilting joint mechanism; and a motor driving the horizontal axle to move the top member between the vertical position and the prone position.

* * * * *